US005924883A

United States Patent [19]

Yamagami et al.

[11] Patent Number: 5,924,883

[45] Date of Patent: Jul. 20, 1999

[54] ELECTRICAL CONNECTOR

[75] Inventors: Yoku Yamagami; Hirokatsu Yaegashi; Tsuyoshi Sakata; Tsutomu Matsuo, all of Tokyo, Japan

[73] Assignee: Hirose Electric Co., Ltd., Tokyo, Japan

[21] Appl. No.: 08/845,373

[22] Filed: Apr. 24, 1997

[30] Foreign Application Priority Data

Apr. 26, 1996 [JP] Japan ..... 8-106663

[51] Int. Cl.[6] ..... H01R 13/62

[52] U.S. Cl. ..... 439/326

[58] Field of Search ..... 439/326, 327, 439/328, 329

[56] References Cited

U.S. PATENT DOCUMENTS 5,695,353 12/1997 Sakata et al. ..... 439/326

*Primary Examiner*—Gary Paumen
*Assistant Examiner*—Javaid Nasri
*Attorney, Agent, or Firm*—Kanesaka & Takeuchi

[57] ABSTRACT

An electrical connector for connecting to a mother board a daughter board having a plurality of pads on a front edge thereof includes a plurality of contact terminals made by stamping and bending a resilient conductive sheet so as to provide first and second retaining sections which are fixed to the insulating housing. The daughter board is inserted between upper and lower contact portions of the contact terminals with a zero-insertion force and then rotated to bring the pads into contact with the contact portions with a predetermined contact force.

4 Claims, 12 Drawing Sheets

ELECTRICAL CONNECTOR

BACKGROUND OF THE INVENTION

1. Field of the Invention

The present invention relates to electrical connectors for connecting to a mother board a daughter board having a plurality of pads on a front edge thereof in a direction perpendicular, oblique, or parallel to the mother board.

2. Description of the Related Art

Recently, an increasing number of low-profile connectors are used for mounting memory modules. A conventional direct insertion type connector fails to meet the low-profile requirement and a variety of zero-insertion-force connectors are used as low-profile connectors.

Japanese patent application Kokai Nos. 230378/85 and 193473/88 disclose such zero-insertion-force connectors. Contact terminals for the electrical connectors are made by stamping a metal sheet having a predetermined thickness. These contact terminals have a very high spring constant because they are stamped from flat work. Consequently, if the spring constant is set to provide a satisfactory contact power for PC boards of the minimum thickness, an excessive force is applied to PC boards of the maximum thickness, causing breakage or difficulty to plug. In addition, the contact terminals are made by stamping so that a considerable amount of rare metal material is wasted. Moreover, the contact terminals made by stamping have contact sections cut by the stamping so that the contact sections must be plated after stamping, resulting in the increased manufacturing costs.

Japanese patent application Kokai No. 78168/90 discloses contact terminals made by stamping and bending a metal sheet instead of those made by stamping alone. By stamping and bending it is possible to avoid the above problems with those made by stamping alone.

FIGS. 12 and 13 show electrical connectors having such contact terminals. The electrical connectors are mounted on mother boards 10 to connect to the mother boards daughter boards 30 or PC boards on which memory modules are mounted. In FIG. 12(A), the daughter board 30 is going to be plugged into the electrical connector 20A which is mounted on the mother board 10. A plurality of terminal receiving grooves are provided in the front, bottom, and rear walls of an opening 25A in an insulation housing 21A of the electrical connector 20A for receiving contact terminals 40A.

The contact terminals are made by stamping and bending a resilient metal sheet so as to provide an upper contact portion 41A on the rear wall of the opening 25A and a lower contact portion 44A on the front wall. The connection sections 48A of every other contact terminals 40A extend downwardly from retaining sections 46A which are fixed to the receiving grooves on the rear wall. The connection sections 48A of the other contact terminals 40A extend downwardly from extension sections 47A which extend forwardly along the bottom wall. The connection sections 48A arranged in a zigzag fashion are inserted into through-holes on the mother board 10 for soldering.

A pair of latch levers 22A are provided on opposite sides of the opening 25A. Latch sections 23A are provided on the upper ends of the latch levers 22A. To plug the daughter board 30 in the electrical connector 20A on the mother board 10, the daughter board 20 is inserted obliquely into the opening 25A and rotated rearwardly as shown in FIG. 12(A). The daughter board 30 flexes the latch levers 22A outwardly and passes the latch sections 23A. The latch levers 22A snap to the original position to hold the daughter board 30 with the latch sections 23.

If the rotating force applied to the daughter board 30 is very large, the insulation housing 21A can be separated from the mother board 10 as shown in FIG. 12(B) because the insulation housing 21A is fixed only by the guide posts and connection sections of contact terminals.

In FIG. 13(A), the daughter board 30 is plugged in the electrical connector 20B mounted on the mother board 10. The electrical connector is substantially identical with that of FIG. 12 except for the shape of contact terminals 40B. The contact terminals 40B are also made by stamping and bending from a resilient metal sheet but the retaining sections are fixed in the terminal receiving grooves on the front wall of the opening 25B. The connection sections 48B of every other contact terminals 40B extend downwardly from the retaining sections 46B fixed in the receiving grooves on the front wall, while the connection sections 48B of the other contact terminals 40B extend downwardly from the extension sections 47B which extend rearwardly along the bottom wall. The connection sections 48B are arranged in a zigzag fashion and inserted into the through-holes of the mother board 10 for soldering.

In FIG. 13(A), the daughter board 30 is always biased forwardly. Consequently, the insulation housing 21B can be separated from the mother board 10 with passage of time as shown in FIG. 13(B).

To solve the above problems, the connection sections of contact terminals are reinforced, the insulation housing is reinforced or offset from the contact terminals, the guide posts are reinforced with flat holding fixings as disclosed in Japanese UM patent application Kokoku No. 22058/95, or the contact pressure is reduced. However, more material is used to reinforce the connection sections of contact terminals or the insulation housing, resulting in the increased manufacturing costs. If the insulation housing is offset from the contact terminals, it is not interchangeable with those of other companies. The use of special fixings increases the number of components, resulting in the increased manufacturing costs. The reduced contact pressure reduces the contact reliability.

SUMMARY OF THE INVENTION

Accordingly, it is an object of the invention to provide an economical and reliable electrical connector able to maintain the contact power and withstand the moment of rotations under connection conditions or excessive forces upon insertion of a daughter board.

According to the invention there is provided an electrical connector for connecting to a mother board a daughter board having a plurality of pads on a front edge thereof, which includes an insulating housing having front, bottom, and rear walls to define an opening into which the daughter board is inserted at an angle with the mother board and then rotated rearwardly to a connection position; a plurality of terminal receiving grooves provided in the front, bottom, and rear walls of the opening; a plurality of contact terminals provided in the terminal receiving grooves and made by stamping and bending a resilient conductive sheet so as to provide first retaining sections fixed in the terminal receiving grooves in either the front or rear walls, connection sections extending from the first retaining sections and electrically connected to conductors of the mother board, reverse U-shaped sections extending upwardly from the first retaining sections and then to inside of the opening to provide upper or lower contact portions, U-shaped sections extending from the reverse U-shaped sections toward either the front or rear wall and then upward along either the front or rear wall; and free end sections extending from the U-shaped sections toward inside of the opening to provide lower or upper contact portions; the reverse U-shaped, U-shaped, and free end sections constituting spring sections flexed at the first retaining sections; the upper and lower contact portions of the contact terminals being spaced at a distance equal to or slightly greater than a thickness of the front edge of the daughter board and brought into contact with the pads on the front edge with a predetermined contact force by rotating the daughter board rearwardly to flex the spring sections; at least one long extension section extending toward the front wall from one of the connection sections; and at least one second retaining section provided on the long extension section for fixing in one of the terminal receiving groove.

According to an embodiment of the invention, the upper and lower contact portions of the contact terminals contact the pads on the front edge when the daughter board is rotated rearwardly to the connection position.

According to another embodiment of the invention, every other contact terminals arranged in the opening of the insulating housing are provided with long extension sections while the connection sections of the remaining contact terminals extend downwardly from the first retaining sections through the bottom wall without the long extension sections.

According to still another embodiment of the invention, the first and second retaining sections are press fitted into or molded integrally with the insulating housing.

DESCRIPTION OF THE PREFERRED EMBODIMENT

Figure 1:
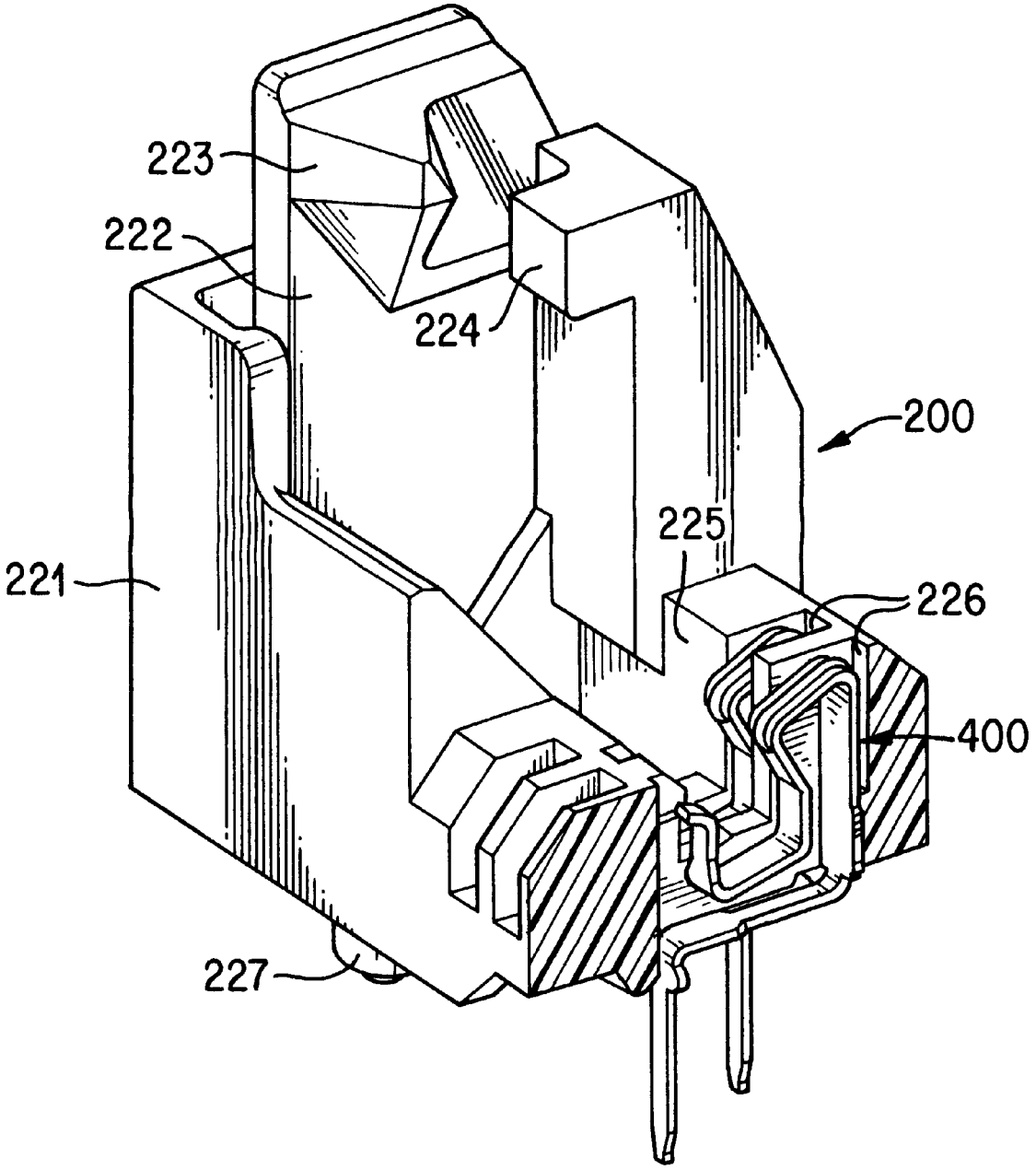
FIG. 1 is a perspective view of an electrical connector according to an embodiment of the invention.

In FIG. 1, an electrical connector 200 includes an insulation housing 221 which is to be mounted on a mother board. An opening 225 extends in the longitudinal direction of the insulation housing 221. A daughter board or a printed circuit board with memory modules mounted thereon is inserted obliquely into the opening 225 and rotated rearwardly to the vertical position.

A plurality of common pads are arranged on a front edge of the daughter board at predetermined intervals. The common pads are connected to terminals of respective components, such as memories, via conductor patters.

A plurality of terminal receiving grooves 226 are provided in the front, bottom, and rear walls of the opening 225 at regular intervals equal to those of the common pads. A plurality of contact terminals 400 are placed in the terminal receiving grooves 226.

A pair of latch levers 222 are provided on opposite sides of the opening 225, and latch sections 223 are provided on the upper ends of the latch levers 222. A projection 224 is provided on the rear wall of the insulation housing 221 near the latch lever 222 to prevent the daughter board from coming out of the electrical connector. An engaging hole is provided in the daughter board at the corresponding position. A pair of guide posts 227 extend downwardly from the bottom of the insulation housing 221.

Figure 5:
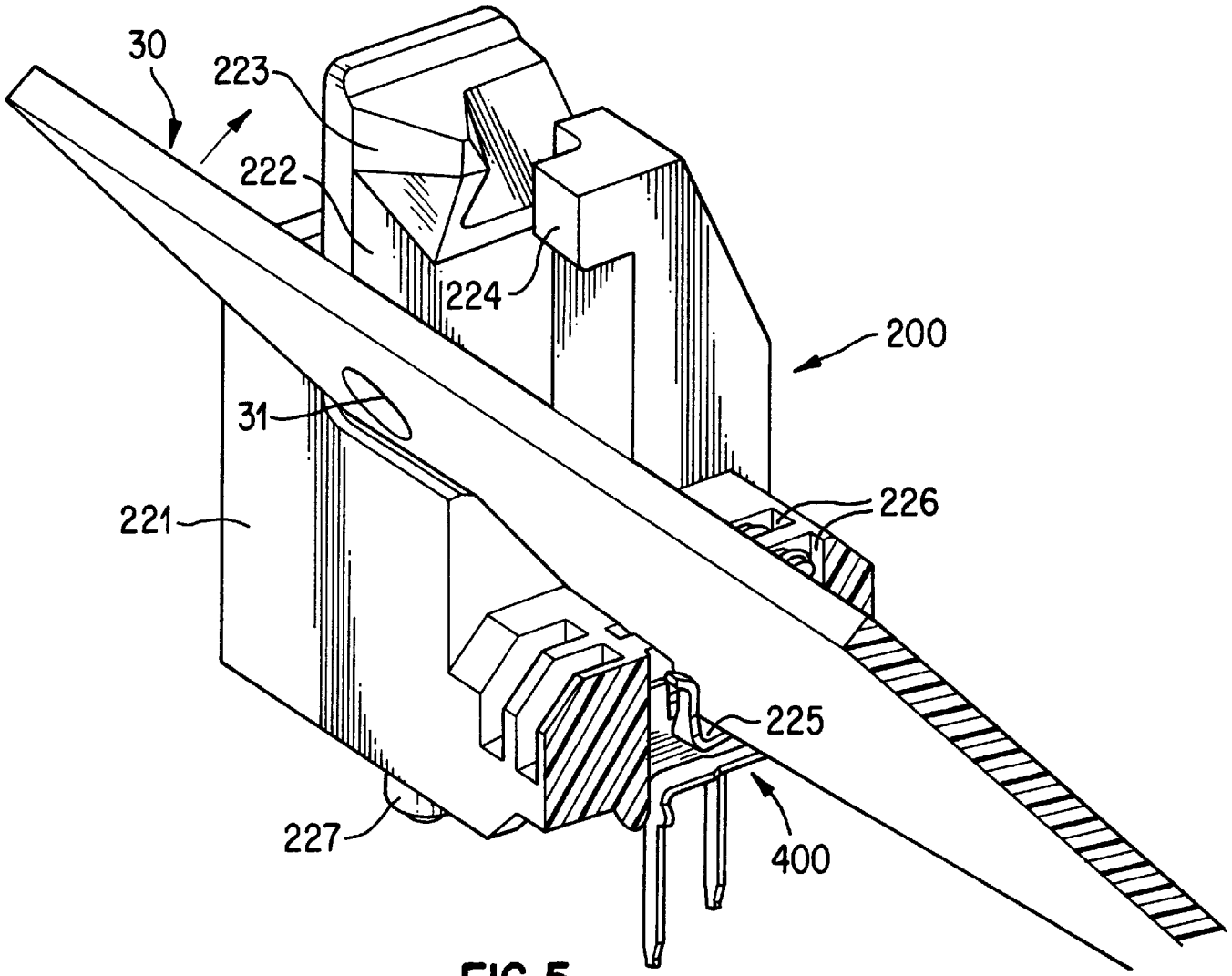
FIG. 5 is a partially cutaway perspective view of the electrical connector of FIG. 1 to which a daughter board is being connected.
Figure 6:
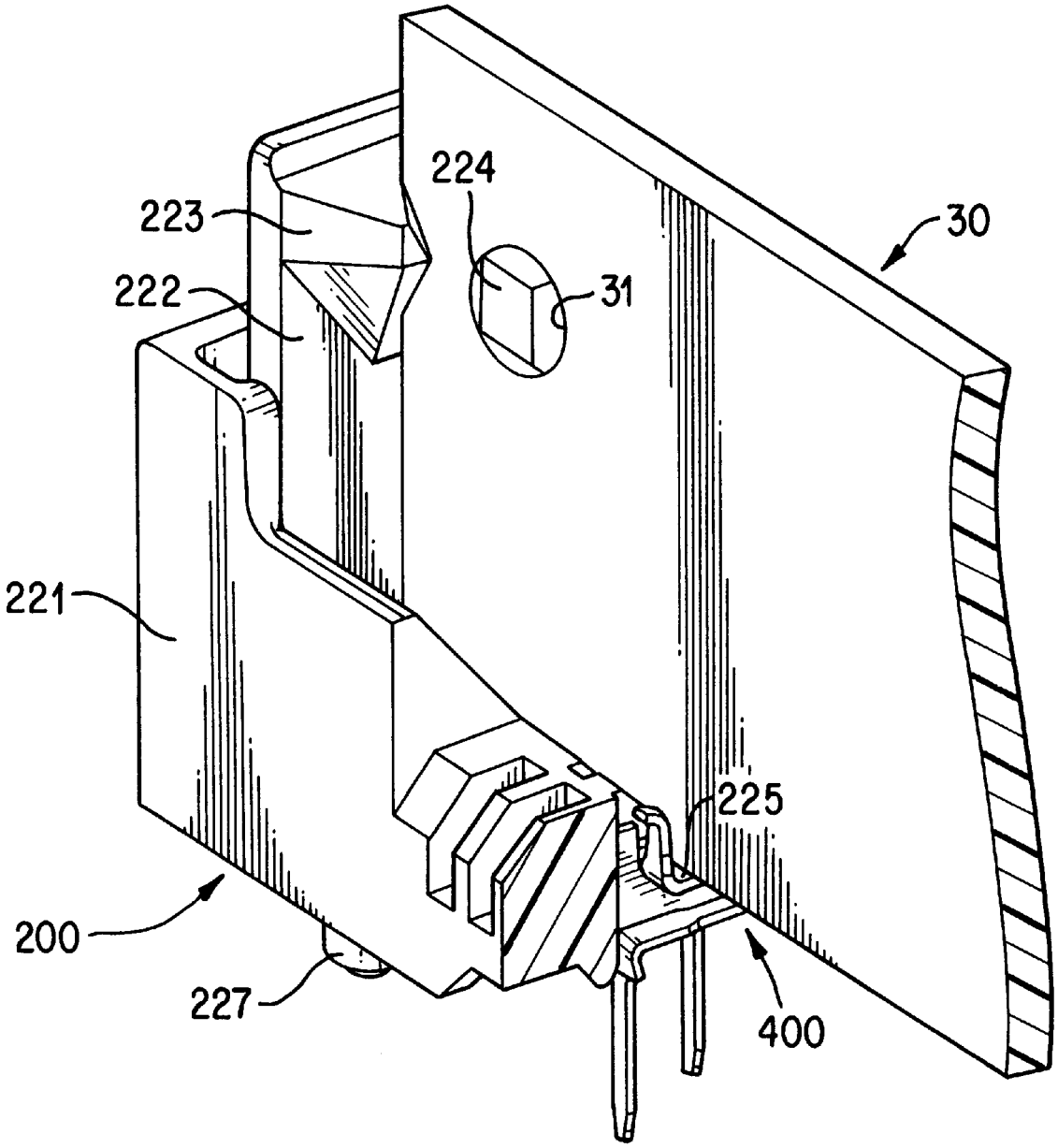
FIG. 6 is a partially cutaway perspective view of the electrical connector of FIG. 1 to which the daughter board has been connected.
Figure 7:
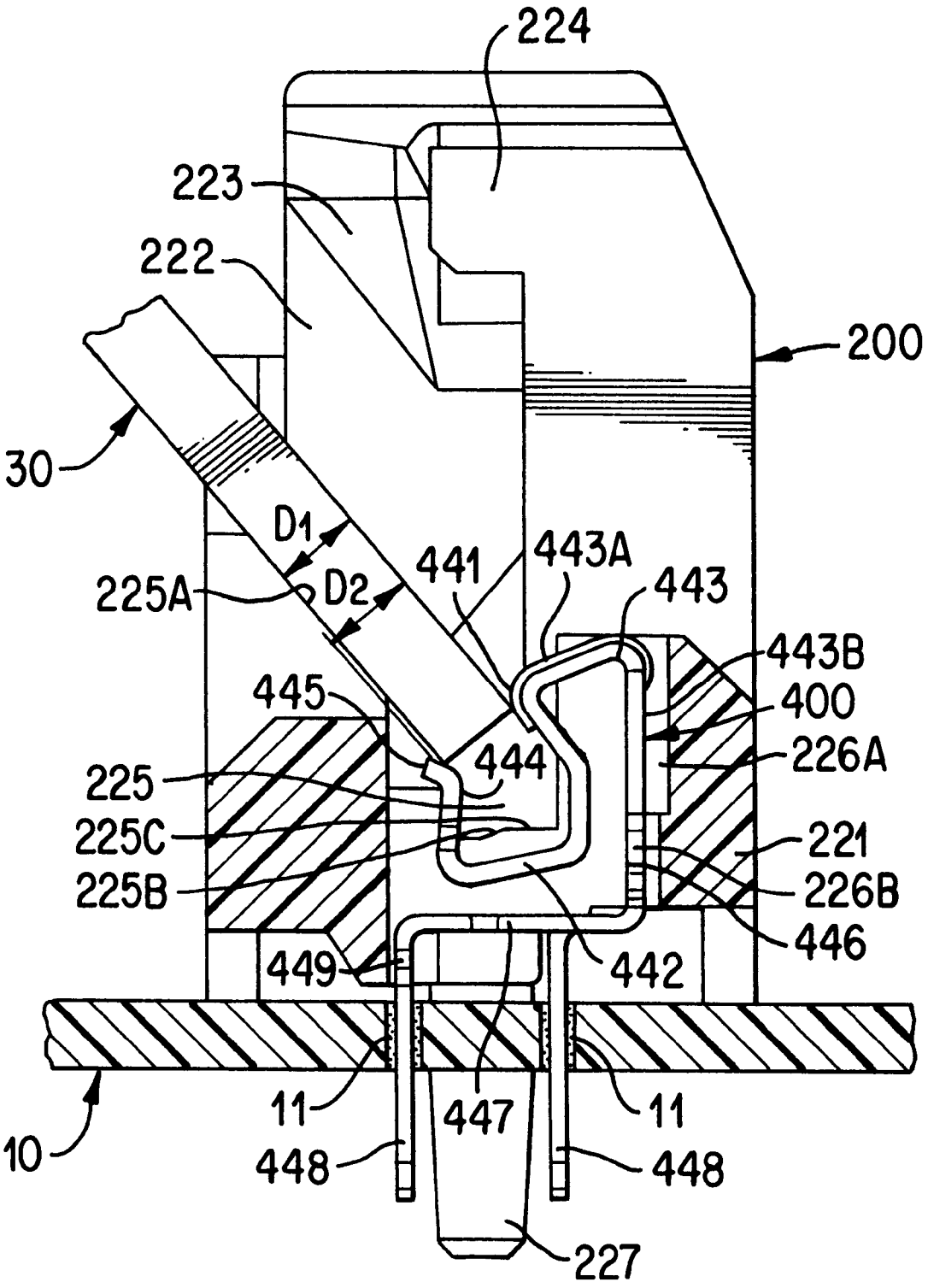
FIG. 7 is a sectional view of the electrical connector of FIG. 1 to which a daughter board is being connected.
Figure 8:
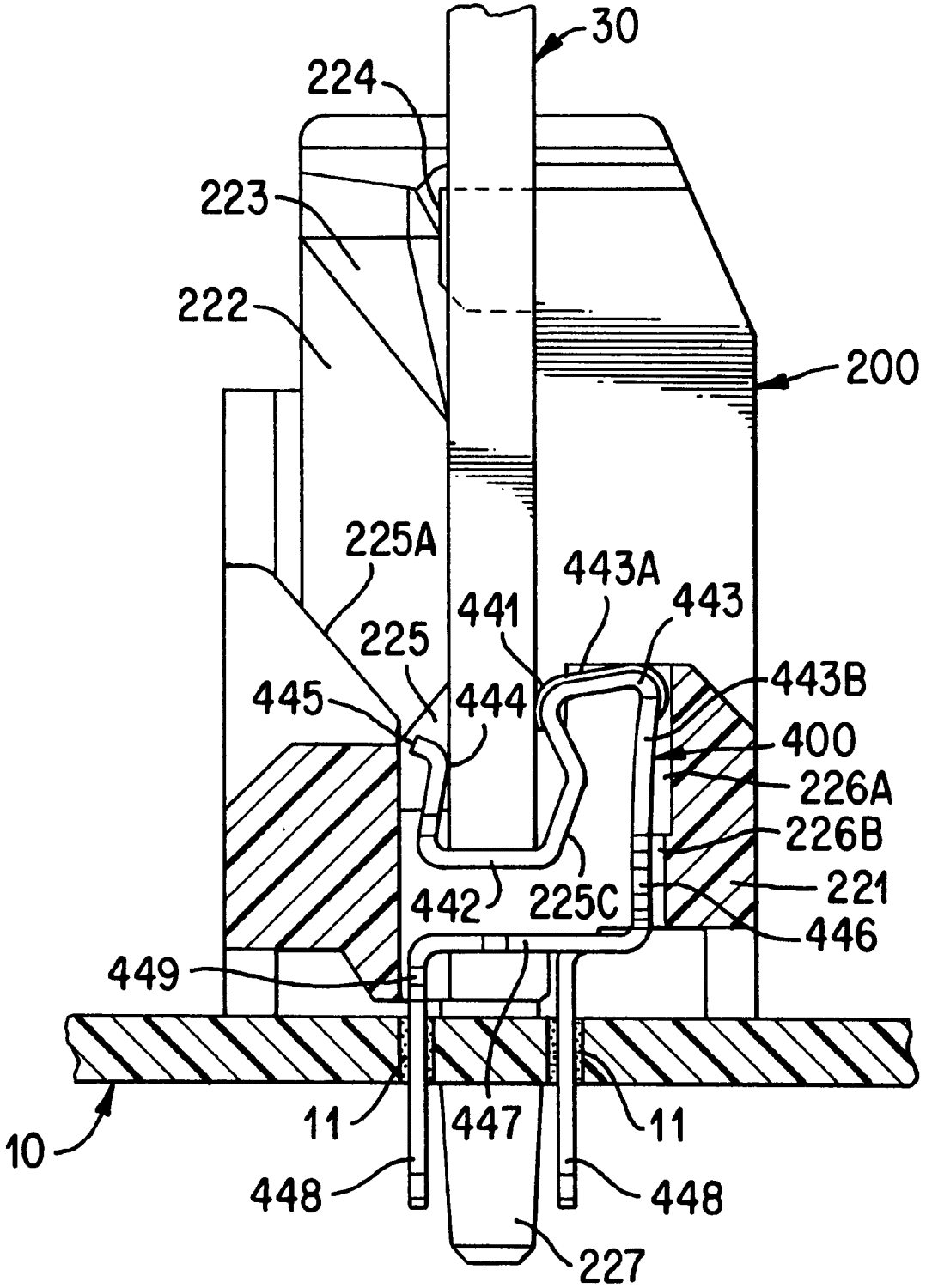
FIG. 8 is a sectional view of the electrical connector of FIG. 1 to which the daughter board has been connected.

As FIGS. 5 and 7 show, a daughter board 30 is inserted into the opening 225 of the insulation housing 221 and rotated rearwardly to connect it in the electrical connector 200. The daughter board 30 flexes the latch levers 222 outwardly and passes the latch sections 223. Consequently, the engaging hole 31 of the daughter board 30 engages the projection 224 while the latch sections 222 hold the daughter board 30 in place. FIGS. 6 and 8 show such a plugging conditions.

To remove the daughter board 30 out of the connector, the latch levers 222 are pulled outwardly so that the daughter board 30 is rotated forwardly by the spring force of contact terminals 400 and passes the latch sections 223 for ready to pull it out of the connector.

Figure 2:
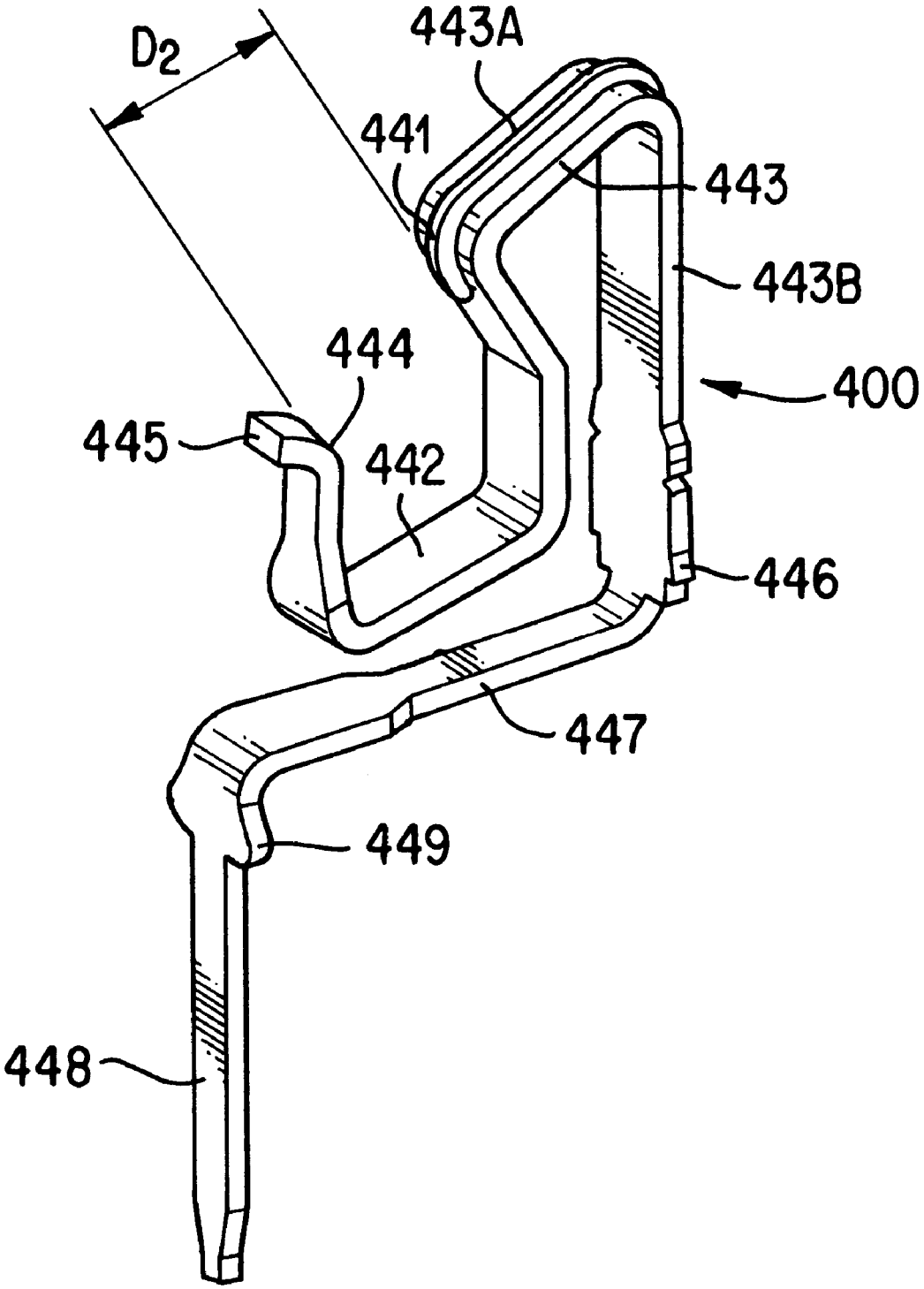
FIG. 2 is a perspective view of one of two types of contact terminals for the electrical connector of FIG. 1.

In FIG. 2, a contact terminal 400 is made by stamping and bending a resilient and conductive sheet of metal. The contact terminal 400 has a first retaining section 446 fixed in the terminal receiving groove on the rear wall of the opening 225 and a long extension section 447 extending to the terminal receiving groove on the front wall of the opening 225. The long extension sections 447 have a second retaining section 449 fixed in the terminal receiving groove on the front wall. A connection section 448 extends downwardly from the second retaining portion 449 for connection to a conductor of the mother board 10.

An reverse U-shaped section 443 extends upwardly from the first retaining section 446 and downwardly to provide an upper contact point 441. A U-shaped section 442 extends to the front wall of the opening and then upwardly along the terminal receiving groove. A free end section 445 extends to the opening 225 and then forwardly to provide a lower contact point 444. A bead 443 is provided from the first retaining section 446 to the upper contact point 441A to provide a large modulus of section, thus minimizing changes under a load and making a floating column 443B of the section between the first retaining section 446 and the upper turning point to keep good contact regardless of a warp of the board. The bead 443 extends to the upper contact point 441 which is used as a contact point for increasing the contact pressure (Hertz stress).

Figure 3:
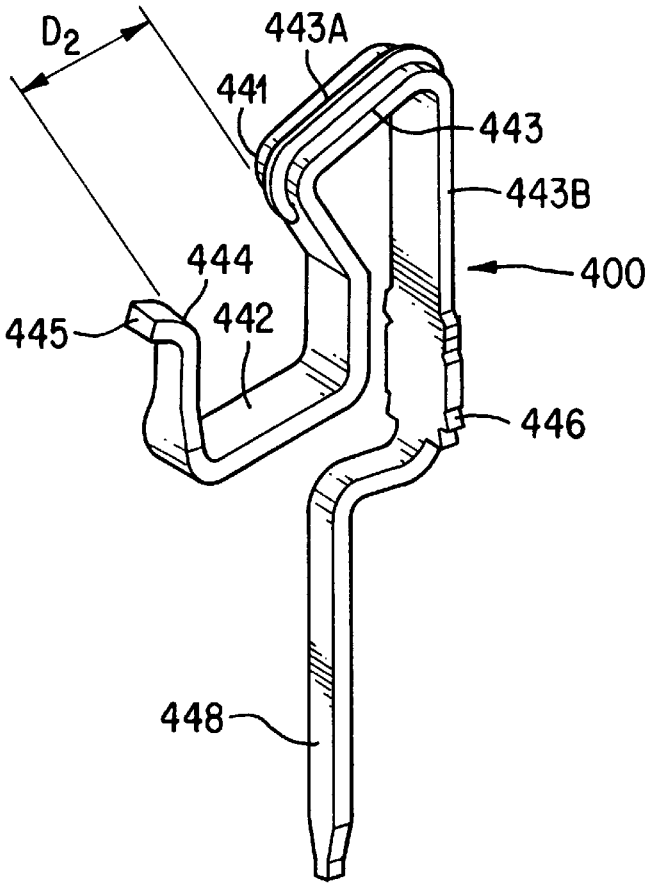
FIG. 3 is a perspective view of the other type of contact terminals for the electrical connector of FIG. 1.

In FIG. 3, another contact terminal 400 is shown. This contact terminal is identical with the contact terminal of FIG. 2 except that the connection section 448 extends downwardly from the first retaining section 446 without a long extension section.

Figure 4:
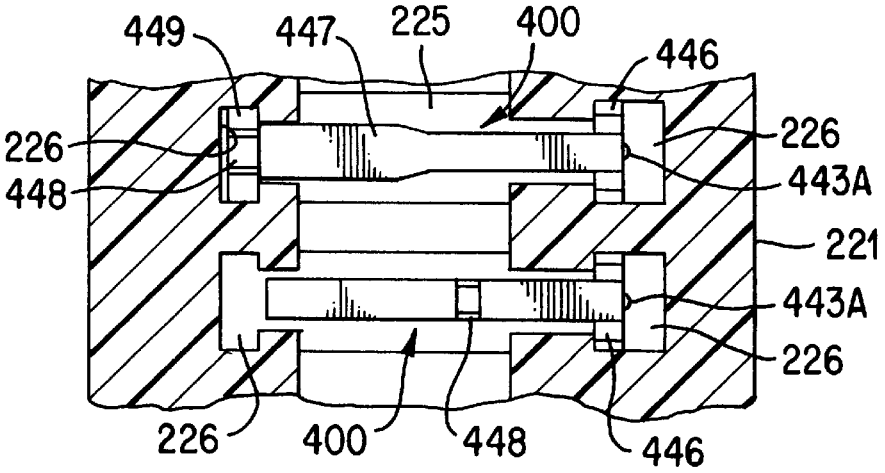
FIG. 4 is a bottom view of part of the electrical connector of FIG. 1.

In FIGS. 4 and 7, the first retaining section 446 of the contact terminal 400 of FIG. 2 is fitted into the terminal receiving grooves 226 on the rear wall while the second retaining section 449 is fitted into the terminal receiving groove 226 on the front wall of the opening. In this way, the contact terminals of FIG. 2 are arranged in every other terminal receiving grooves 226. The first retaining section 446 of the contact terminal 400 of FIG. 3 is fitted into the terminal receiving groove 226 on the rear wall of the opening. In this way, the contact terminals 400 of FIG. 3 are arranged in every other terminal receiving grooves 226. The connection sections 448 project downwardly from the bottom of the opening 225 in a zigzag arrangement in two rows.

In FIG. 7, the distance D2 between the upper contact point 441 and the lower contact point 444 of the contact terminals 400 is equal to or slightly greater than the thickness D1 of the daughter board 30. The reverse U-shaped section 443 including the upper contact point 441, the U-shaped section 442, and the free end section 445 including the lower contact point 444 are flexible, with the first retaining section 446 as a fulcrum. As FIGS. 7 and 8 show, the upper portion 226A of the terminal receiving groove 226 has a relatively large space to accommodate the floating column 443B of the contact terminal 400. The lower portion 226B of the terminal receiving groove 226 provides a space through which the bead 443A passes.

How to connect the daughter board 30 to the electrical connector 200 will be described with reference to FIGS. 7 and 8. As FIG. 7 shows, the daughter board 30 is inserted obliquely into the opening 225 of the insulation housing 221 along a slanted guide face 225A provided on the upper front portion of the opening 225. Since the distance D2 between the upper contact point 441 and the lower contact point 444 is equal to or slightly greater than the thickness D1 of the daughter board 30, there is no or little resistance to the insertion of the daughter board 30 so that the daughter board 30 is inserted in the opening 225 with zero-insertion force.

When the front or lower end of the daughter board 30 abuts against the slanted face 225B of the bottom wall of the opening 225, the daughter board 30 is rotated towards the rear wall of the opening 225. The daughter board 30 pushes the contact terminals 400 at the upper contact points 441 to flex the reverse U-shaped sections 443, the U-shaped sections 442, and the free end sections 445, with the first retaining section as a fulcrum. The daughter board 30 passes the latch sections 223 into the latch position as shown in FIG. 8.

FIG. 8 shows a relationship between the contact terminals 400 and the front edge of the daughter board 30 under such latch conditions. The front end face of the daughter board 30 is placed on the flat face 225C of the bottom wall of the opening 225, and the common pads (not shown) on both sides of the front edge are held between the upper and lower contact points 441 and 444.

The operations of the respective components from the angular insertion of the daughter board 30 in FIG. 7 and the connection condition in FIG. 8 will be described in more detail. First of all, the rearward rotation of the daughter board 30 brings the upper contact points 441 toward the rear wall. Then, the floating columns 443B are flexed at the first retaining sections 446 into the enlarged space 226A in the rear wall. The flexure of the floating columns 443B bring the upper contact points 441 to a position which is slightly higher than the prior position of FIG. 7. Such movement of the floating columns 443B and the upper contact points 441 brings the lower contact points 444 to a position in the opening 225 which is much higher than the prior position of FIG. 7.

The contact terminals 400 are made so that the amount of upward movement of the lower contact points 444 is larger than that of the upper contact points 441. Consequently, the difference between the upper and lower contact points 441 and 444 in FIG. 8 is considerably smaller than that of FIG. 7, thus minimizing the moment of rotations or torque upon the daughter board 30 which is caused by the upper and lower contact points 441 and 444. Thus, the warp of the daughter board 30 held by the latch sections 223 is minimized.

The cooperation between the floating columns 443B and the enlarged space 226A in the rear wall allows the resilient sections consisting of the reversed U-shaped sections 443, the U-shaped sections 442, and the free end sections 445 to flex at the retaining sections 446 so that it is possible to keep constant the contact power of the upper and lower contact points 441 and 444 regardless of the warp of the daughter board 30.

Figure 12A:
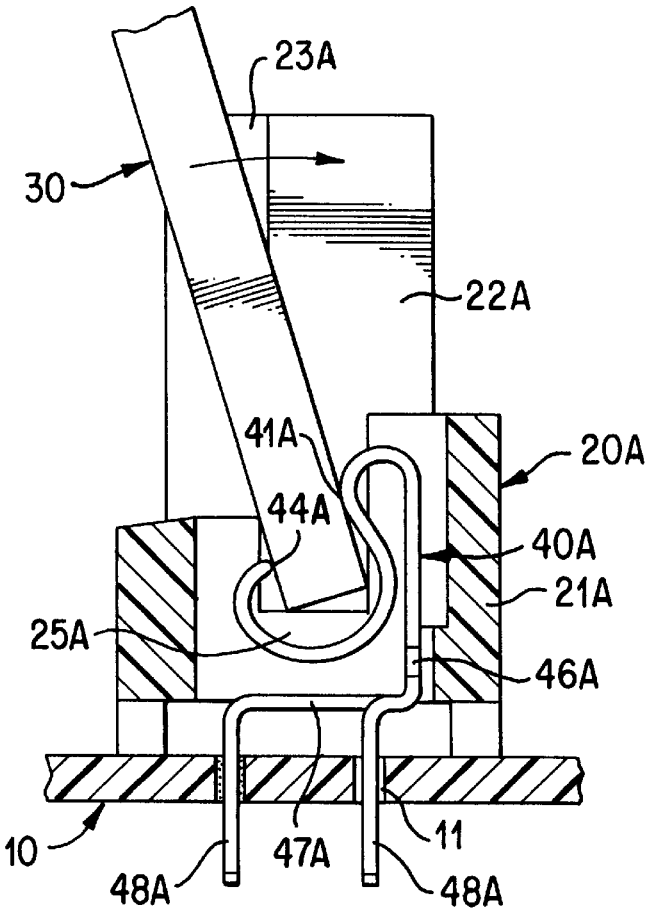
FIG.12(A) PRIOR ART
FIGS. 12(A) and (B) are sectional views of a conventional electrical connector.
Figure 12B:
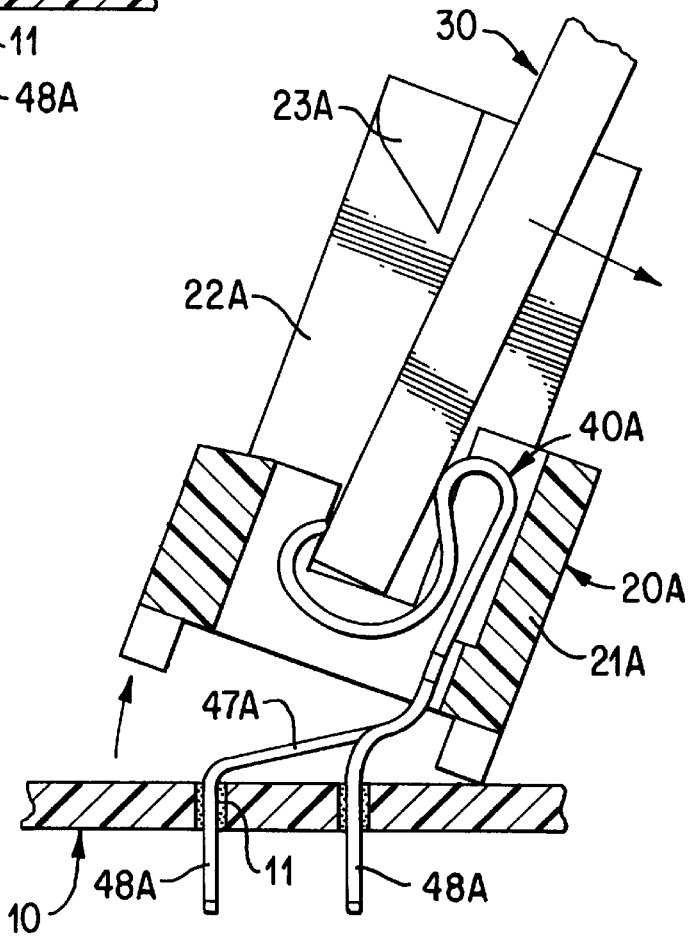
FIG.12(B) PRIOR ART

The second retaining sections 449 of every other contact terminals 400 are press fitted to the insulating housing 221 so that the insulating housing 221 is not separated from the mother board 10 when excessive rotary force is applied to the insulating housing 221 upon connection of the daughter board 30 because the retaining sections 449 prevent the contact terminals from being deformed as shown in FIG. 12(B) so that the retention power of the contact terminals 400 is added up to the retention power of the guide posts 227.

Figure 9:
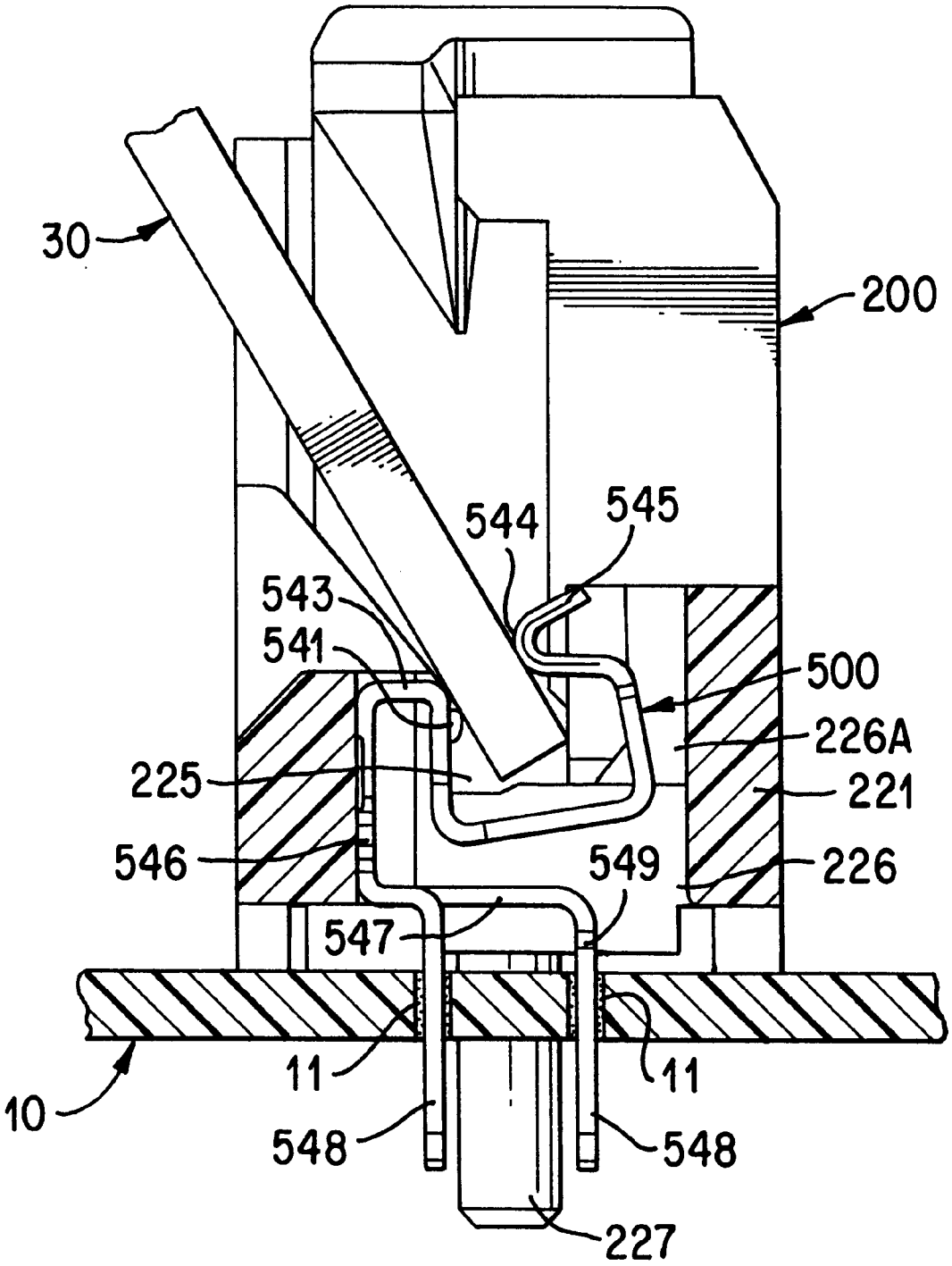
FIG. 9 is a sectional view of an electrical connector according to another embodiment of the invention to which a daughter board is being connected.
Figure 10:
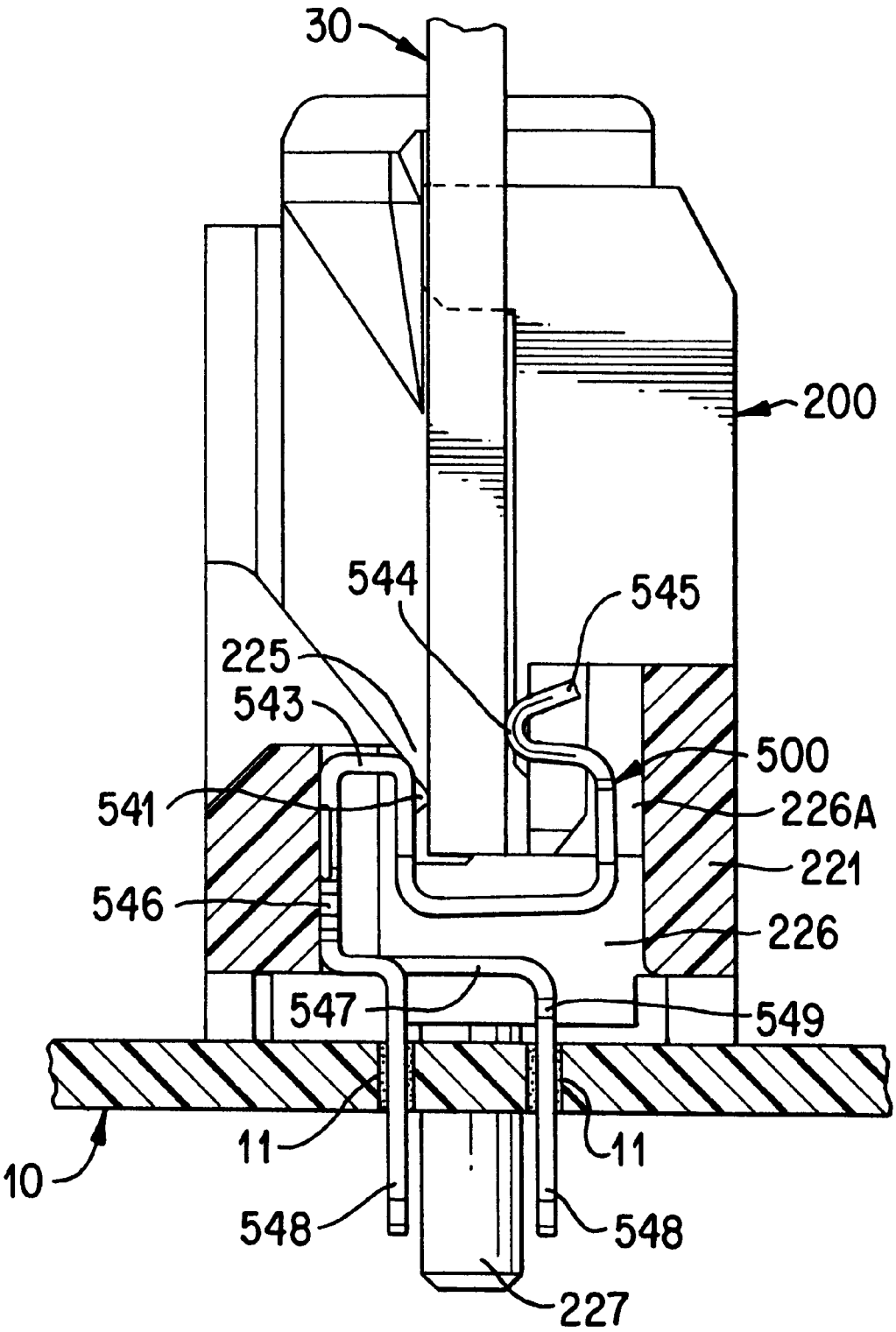
FIG. 10 is a sectional view of the electrical connector of FIG. 9 to which the daughter board has been connected.

FIGS. 9 and 10 show an electrical connector according to another embodiment of the invention. The electrical connector 200A is substantially the same as the above embodiment except that the shape of contact terminals 500 are different from the contact terminals 400.

As best shown in FIG. 9, contact terminals 500 of one of two types are made by cutting and bending a substantially flat resilient metal sheet. The contact terminals 500 of this type have a first retaining section 546 fixed in terminal receiving grooves 226 in the front wall of the opening 225 and a long extension sections 547 extending in terminal receiving grooves in the bottom wall. A second retaining section 549 is provided on the long extension section 547 and fixed in terminal receiving grooves on the side of the rear wall. A connection section 548 extends downwardly from the second retaining section 549 and is connected to a conductor of the mother board 10.

The contact terminals 500 further have a reverse U-shaped section 543 extending upwardly from the first retaining section 546 and then laterally to the opening to provide a lower contact section 541, a U-shaped section 542 extending from the reverse U-shaped section 543 toward the rear wall and then upwardly in the terminal receiving groove in the rear wall, and a free end section 545 extending from the U-shaped section 542 to the inside of the opening 225 to provide an upper contact section 544.

As shown in FIG. 9, contact terminals 500 of the other type are the same as the above contact terminals except that connection sections 548 extend downwardly from the first retaining sections 546 without the long extension sections.

The contact terminals 500 of these two types are arranged alternately in the terminal receiving grooves 226 of the insulating housing 221. That is, the contact terminal 500 of the first type are arranged in every other terminal receiving grooves 226 such that the first and second retaining sections 546 and 549 are press fitted in the terminal receiving grooves 226 in the front and rear walls, respectively. The contact terminals 500 of the second type are arranged in every other terminal receiving grooves 226 such that the first retaining sections 546 are press fitted in the terminal receiving grooves 226 in the front wall of the insulating housing 221. The connection sections 548 of the contact terminals 500 extend downwardly through the terminal receiving grooves in the bottom wall of the opening so that they are arranged in a zigzag fashion, too.

How to connect the daughter board 30 to the electrical connector 200A is substantially the same as the electrical connector 200 and its description will be omitted.

Figure 13A:
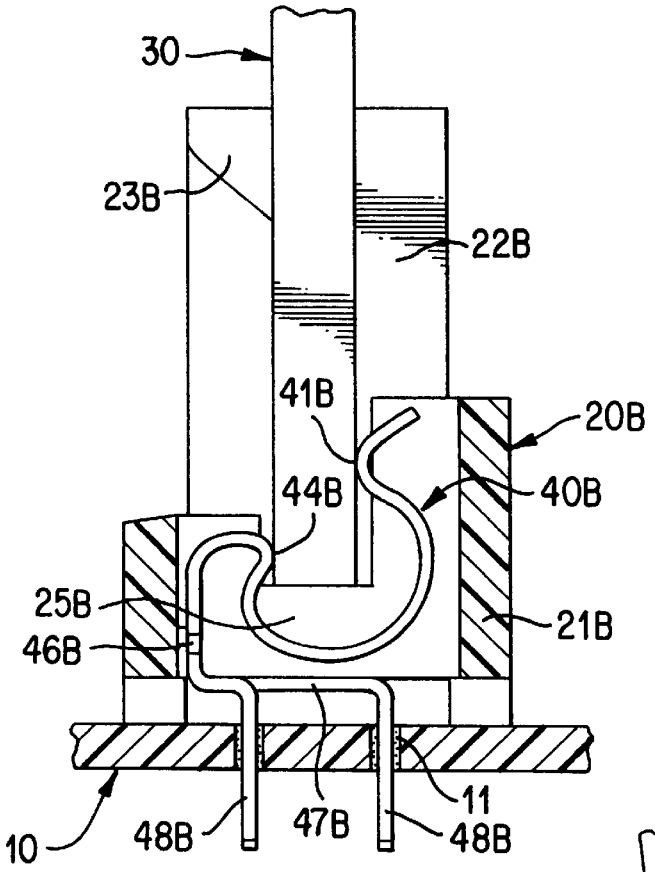
FIG.13(A) PRIOR ART
FIGS. 13(A) and (B) are sectional view of another conventional electrical connector.
Figure 13B:
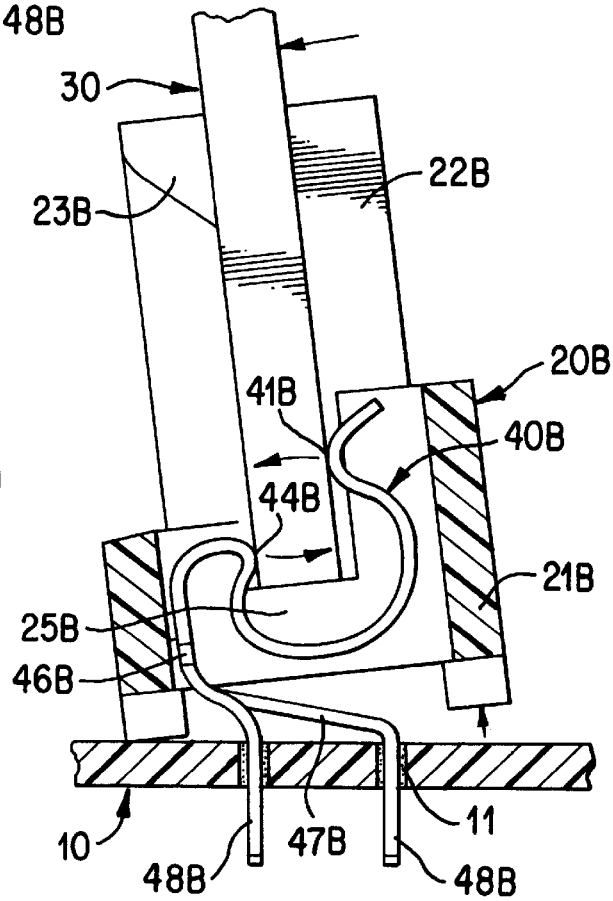
FIG.13(B) PRIOR ART

In the electrical connector 200A, the second retaining sections 549 are press fitted in the insulating housing 221 so that the insulating housing 221 is not separated from the mother board 10 with the passage of time owing to the bias to rotate forwardly the daughter board 30 under the connection conditions in FIG. 10. Since the second retaining sections 549 are press fitted in the insulation housing 221, the contact terminals 500 are not deformed such as shown in FIG. 13(B). Consequently, the fixing power by the contact terminals 500 are added up to the fixing power of the guide posts 227 to fix the insulating housing 221 to the mother board 10.

Figure 11A:
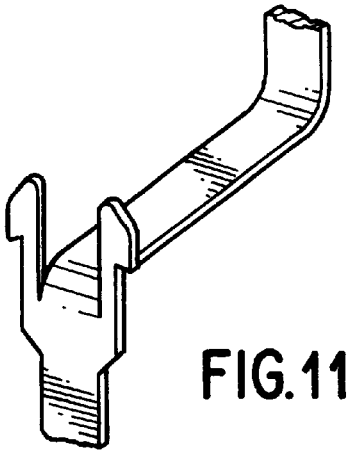
FIGS. 11(A)–(C) are perspective views of retaining sections of contact terminals according to various embodiments of the invention.
Figure 11B:
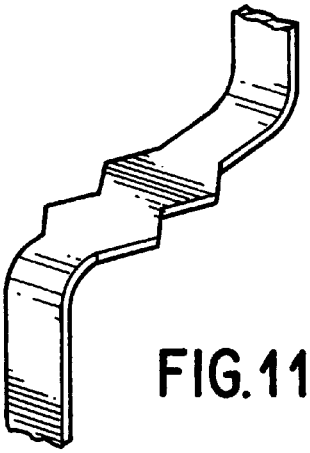
Figure 11C:
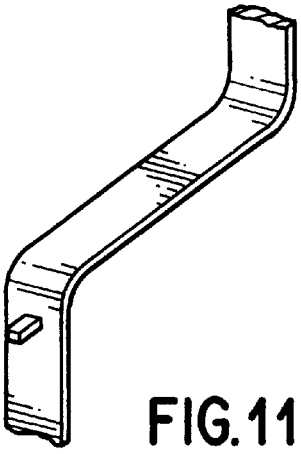

FIGS. 11(A)–(C) show various modifications for the second retaining sections 449 or 549 of the contact terminals 400 or 500. In this way, the shapes of the first and second retaining sections are not limited to those of FIGS. 1–10 but can be those capable of being fixed in the insulating housing. The shape of the terminal receiving grooves may be modified according to the shape of the retaining sections. The first and second retaining sections press fitted in the insulation housing may be molded integrally with the insulation housing.

The daughter board connected to the electrical connector at right angles with the mother connector may be connected to the electrical connector at a given angle, for example, in parallel to the mother board.

Since the second retaining sections of the long extension sections are fixed to the insulating housing, the electrical connector does not fall with the passage of time owing to the moment of rotations under the connection conditions because there are fixing points on opposite sides of the base point of the moment of rotations.

Since the second retaining sections of the long extension sections are fixed to the insulating housing, even if an excessive load is applied to the daughter board, the electrical connector is not separated from the mother board.

Since the second retaining sections of the long extension sections are fixed to the insulating housing, the contact terminals are reinforced and hardly deformed.

Since the second retaining sections are fixed to the insulating housing to reinforce the press-fit leads, it is possible to use a thinner metal sheet for making contact terminals, thus reducing the costs.

Since the first and second retaining sections are fixed to the insulating housing, the fixing power of the contact terminals is increased.

Since the insulating housing is fixed on opposite sides, the insulation material is deformed uniformly by press-fit, thus minimizing the warp of the insulation housing.

What is claimed is:

1. An electrical connector for connecting to a mother board a daughter board having a plurality of pads on a front edge thereof, comprising:

an insulating housing having front, bottom, and rear walls to define an opening into which said daughter board is inserted at an angle with said mother board and then rotated rearwardly to a connection position;

a plurality of terminal receiving grooves provided in said front, bottom, and rear walls of said opening;

a plurality of contact terminals provided in said terminal receiving grooves and made by stamping and bending a resilient conductive sheet so as to provide first retaining sections fixed in said terminal receiving grooves in either said front or rear walls, connection sections extending from said first retaining sections and electrically connected to conductors of said mother board, reverse U-shaped sections extending upwardly from said first retaining sections and then to inside of said opening to provide first upper or second lower contact points, U-shaped sections extending from said reverse U-shaped sections toward either said front or rear wall and then upward along either said front or rear wall; and free end sections extending from said U-shaped sections toward inside of said opening to provide first lower or second upper contact points;

said reverse U-shaped, U-shaped, and free end sections constituting spring sections flexed at said first retaining sections;

said upper and lower contact points of said contact terminals being spaced at a distance equal to or slightly greater than a thickness of said front edge of said daughter board and brought into contact with said pads on said front edge with a predetermined contact force by rotating said daughter board rearwardly to flex said spring sections;

at least one long extension section extending toward said front or rear wall from one of said connection sections; and at least one second retaining section provided on said long extension section for fixing in one of said terminal receiving groove.

2. An electrical connector according to claim 1, wherein said upper and lower contact points of said contact terminals contact said pads on said front edge when said daughter board is rotated rearwardly to said connection position.

3. An electrical connector according to claim 1 or 2, wherein every other contact terminals arranged in said opening of said insulating housing are provided with long extension sections while said connection sections of the remaining contact terminals extend downwardly from said first retaining sections through said bottom wall without said long extension sections.

4. An electrical connector according to claim 1, 2, or 3, wherein said first and second retaining sections are press fitted into or molded integrally with said insulating housing.

* * * * *